United States Patent [19]

Travill

[11] Patent Number: 4,738,793

[45] Date of Patent: Apr. 19, 1988

[54] PROCESS FOR PRODUCING DETERGENT POWDER OF HIGH BULK DENSITY

[75] Inventor: Andrew W. Travill, Bebington, Wirral, England

[73] Assignee: Lever Brothers Company, New York, N.Y.

[21] Appl. No.: 921,551

[22] Filed: Oct. 21, 1986

[30] Foreign Application Priority Data

Nov. 1, 1985 [GB] United Kingdom ..... 8526998

[51] Int. Cl.[4] ..... C11D 7/14

[52] U.S. Cl. ..... 252/135; 252/174.21; 252/174.22; 252/174.14; 252/DIG. 1

[58] Field of Search ..... 252/135, 174.21, 174.22, 252/DIG. 1, 174.14

[56] References Cited

U.S. PATENT DOCUMENTS

| | | | |
|---|---|---|---|
| 4,127,496 | 11/1978 | Stokes | 252/102 |
| 4,347,168 | 8/1982 | Murphy et al. | 252/547 |
| 4,375,422 | 3/1983 | Blackstone | 252/110 |
| 4,399,048 | 8/1983 | Gangwisch et al. | 252/91 |
| 4,652,391 | 3/1987 | Balk | 252/99 |
| 4,664,950 | 5/1987 | Wixon | 427/214 |

*Primary Examiner*—Paul Lieberman
*Assistant Examiner*—Isabelle Rodriguez
*Attorney, Agent, or Firm*—Milton L. Honig; James J. Farrell

[57] ABSTRACT

Detergent powders of high bulk density, containing nonionic surfactant and sodium carbonate, are prepared by spray-drying a slurry of low moisture content (not exceeding 25% by weight) containing sodium sulphate as a sodium carbonate hydration inhibitor.

6 Claims, No Drawings

PROCESS FOR PRODUCING DETERGENT POWDER OF HIGH BULK DENSITY

TECHNICAL FIELD OF INVENTION

This invention relates to a process for production of detergent powder by spray-drying.

BACKGROUND

In a spray-drying process there are two opposing factors; the more water which is present in the crutcher slurry, the more has to be evaporated, with a resultant increase in costs. Against that, the less water present, the more viscous the crutcher slurry becomes, until a point is reached where it cannot be pumped and metered. An additional factor, however, is that the market is beginning to move towards denser products. Whereas ten years ago a spray-dried detergent powder could have an ex-factory bulk density of 500 g/liter, nowadays a bulk density of 600 to 650 g/liter or more might be required. It is now generally accepted that, other things being equal, spray-drying of a slurry having a low water content leads to a high bulk density product, and so industrial research began to seek ways of spray-drying low water content crutcher slurries without encountering the problem of high slurry viscosity.

We have now discovered a crutcher slurry composition which exhibits exceptionally low viscosity even at low water content, enabling it to be spray-dried to a high bulk density detergent powder.

DEFINITION OF INVENTION

Accordingly the present invention provides a process for the production of a detergent powder by spray-drying, which comprises the steps of:

(i) preparing an aqueous crutcher slurry comprising nonionic surfactant, sodium carbonate and sodium sulphate in a weight ratio of said carbonate to said sulphate not exceeding 1:1, and having a water content not exceeding 25% by weight; and (ii) spray-drying the slurry to give a powder comprising from 5 to 15% by weight of the nonionic surfactant, from 15 to 40% by weight of sodium carbonate, and sodium sulphate in a weight ratio of sodium carbonate to sodium sulphate not exceeding 1:1, and having a bulk density of at least 675 g/liter.

DESCRIPTION OF INVENTION

Preferably the water content will be from 20 to 24% by weight of the slurry, in which case it will be possible to spray-dry the powder to a bulk density above 700 g/liter, desirably from 700 to 900 g/liter. Generally it will be preferred to reduce the water content to the minimum practical level, although the percentage at which this minimum occurs will vary with the content of the other components of the formulation. For example, for a given level of sodium carbonate the viscosity of the slurry will fall steeply with increase in the nonionic surfactant content, and so slurries containing higher levels of nonionic surfactant will be capable of being processed at lower water contents.

The sodium carbonate to sodium sulphate ratio is preferably within the range of from 0.2:1 to 1:1, more preferably from 0.25:1 to 0.9:1.

The slurry viscosity was found to approach a minimum when the mole ratio of the two salts was approximately 1:2, that is to say, when the weight ratio was approximately 0.37:1.

Preferably the slurry should be formulated so that the viscosity is less than 20 poise, more preferably less than 15 poise, measured at a shear rate of 50 $secs^{-1}$.

As implied above, it is essential to the successful application of the process of the invention that the slurry should contain a nonionic surfactant. Preferably the nonionic surfactant will be an ethoxylated primary or secondary alcohol having a carbon chain length in the hydrophobic portion of from 5 to 25, and containing from about 5 to about 35 moles of ethylene oxide per mole of alcohol. Examples of such materials are ethoxylates of the Dobanol and Neodol (Registered Trade Mark) alcohols, sold by Shell Chemicals Limited, and ethoxylates of the Tergitol (Registered Trade Mark) alcohols sold by Union Carbide Corporation. However, other types of nonionic surfacants can also be used, alkyl phenol ethoxylates for example.

It is also essential that the slurry should contain sodium carbonate, and this will normally perform the detergency builder function which will be required of the product in use. However, other detergency builders may be used in conjunction with the sodium carbonate provided that they do not result in the slurry becoming too viscous at the water content required to obtain the desired high bulk density on spray-drying. Thus, small amounts of phosphate builders such as sodium tripolyphosphate, sodium pyrophosphate and sodium orthophosphate may be used. Amorphous or crystalline sodium aluminosilicates may also be used, as may organic detergency builders such as sodium nitrilotriacetate, sodium citrate and sodium carboxymethyloxysuccinate. These non-carbonate builders will not generally be needed in amounts more than about 10% by weight.

Another essential ingredient in the slurry is sodium sulphate, in a defined weight ratio to the sodium carbonate. Without wishing to be bound by theory, it is believed that the sodium sulphate functions as a carbonate hydration inhibitor, which will encourage the formation of cubic crystals of the double salt Burkeite which pack together tightly with minimum entrainment of water. In the absence of an inhibitor, needle-shaped crystals can be formed which interlock in the slurry entraining water as they grow and thus increasing the amount of water required by the slurry and hence required to be evaporated during the spray-drying process.

The slurries will normally also contain sodium silicate. Not only can this exert some detergency building effect, but it is a powerful inhibitor of corrosion which might otherwise be produced when the spray-dried powder is used in a washing machine. Sodium silicate will generally be present in the slurry in a quantity sufficient to provide from about 5 to 15% in the finished detergent powder.

Although it is intended that the process should be applied to the production of powders predominantly containing nonionic surfactant, some anionic surfactants may also be present in the slurries. Typical anionic surfactants include sodium alkylbenzene sulphonates, sodium alkyl sulphates, sodium alkane sulphonates and sodium alkyl ether sulphates. However, since the presence of these surfactants in any substantial quantity leads to a reduction of the bulk density of the spray-dried powder, it is strongly preferred that their maximum content should be confined to 2% by weight of the slurry. Compositions free of anionic surfactants are preferred.

The slurries can also contain a number of optional components such as lather controllers, anti-redeposition agents such as sodium carboxymethylcellulose, fabric softening agents such as quaternary ammonium salts either alone or in combination with clays, anti-ashing aids, starches, slurry stabilisers such as copolymers of ethylene and maleic anhydride, and of vinyl methyl ether and maleic anhydride, usually in salt form: antioxidants and fluorescers.

In a final process stage the spray-dried powder produced can be dosed with heat-sensitive components in the amounts required to produce a finished powder. The usual heat-sensitive components which are added in this manner are sodium perborate mono- and tetrahydrates, sodium percarbonates and acid bleach precursors such as tetraacetylethylene diamine, tetraacetylglycouril and sodium nonyl oxybenzene sulphonate, perfumes, enzymes and composite adjuncts. The process is especially suitable for use where it is intended to add composite adjuncts to the spray-dried powder in a dry-dosing step, since such adjuncts normally have very high bulk density and tend to separate from lighter powders. Examples of composite adjuncts are antifoam granules, for instance granules based on a starch core having a coating of a mixture of liquid and waxy hydrocarbons; composite coloured speckles containing spray-dried base powder granulated with a coloured binder solution; adjuncts containing calcium carbonate seed crystals such as high surface area calcite (80–90 $m^2g^{-1}$); and special bleach adjuncts.

EXAMPLES

The invention will be further described in the following non-limiting Examples, in which parts and percentages are by weight.

EXAMPLE 1

An aqueous slurry was formulated as follows and spray-dried:

| | % by weight | |
|---|---|---|
| | slurry | powder |
| $C_{14-15}$ primary alcohol 11EO ethoxylate | 6.9 | 8.7 |
| Sodium silicate (2.4 R) | 8.1 | 10.2 |
| Sodium soap of coconut fatty acid | 0.1 | 0.1 |
| Sodium carboxymethylcellulose | 0.1 | 0.1 |
| Sodium carbonate | 27.0 | 34.0 |
| Sodium sulphate | 33.7 | 42.6 |
| Water | 24.1 | 4.3 |
| | 100.0 | 100.0 |

The physical properties of the spray-dried powder were measured by conventional methods and were as follows:

| | |
|---|---|
| Bulk density (g/liter) | 788 |
| Dynamic flow rate (ml/s) | 109 |
| Compressibility (% v/v) | 12 |

To 87.8 parts of this powder were added the following components:

Calcite adjunct consisting of:

| | |
|---|---|
| Calcite | 20 parts |
| Sodium carbonate | 5 parts |
| Nonionic surfactant | 4 parts |
| Sodium carboxymethylcellulose | 0.7 parts |
| Water | 1.6 parts |
| | 31.3 parts |
| Bleach ingredients and minor ingredients | 14.2 parts |

The final powder thus had the following composition:

| | Weight % |
|---|---|
| Nonionic surfactant | 8.8 |
| Sodium silicate (2.4 R) | 6.7 |
| Sodium soap of coconut fatty acid | 0.1 |
| Sodium carboxymethyl cellulose | 0.6 |
| Sodium carbonate | 26.2 |
| Sodium sulphate | 28.0 |
| Calcite | 15.0 |
| Bleach ingredients and minor ingredients | 10.6 |
| Water | 4.0 |
| | 100.0 |

The physical properties of the powder produced were as follows:

| | |
|---|---|
| Bulk density (g/liter) | 750 |
| Dynamic flow rate (ml/s) | 120 |
| Compressibility (% v/v) | 7.6 |

It can be seen that the spray-dried powder produced by the process of the invention is of such a high bulk density that it is actually higher than the bulk density of the postdosed materials, which were processed in a pan granulator.

Thus the finished powder bulk density is less than that of the spray-dried powder.

EXAMPLES 2 TO 4

Five slurries were prepared to give the following formulation after spray-drying:

| | % |
|---|---|
| Sodium carbonate and sodium sulphate in varying ratios | 80 |
| Nonionic surfactant (Neodol (Trade Mark) 45 11EO) | 6 |
| Sodium silicate | 9 |
| Miscellaneous solids | 1 |
| Water | 4 |
| | 100 |

The Table that follows details the five slurries: A and B (comparative), and 2, 3 and 4 (in accordance with the invention). The % Burkeite formation (based on the sodium carbonate and sodium sulphate) was determined by X-ray diffraction. The slurry viscostion were measured at a shear rate of 50 $sec^{-1}$.

It will be seen that a minimum value of slurry viscosity, and a maximum value of powder density, were obtained when the ratio of sodium carbonate to sodium sulphate was 0.37:1 (1:2 mole ratio), and the amount of Burkeite formed was at a maximum.

| | EXAMPLES 2 TO 4 | | | | |
|---|---|---|---|---|---|
| | A | B | 2 | 3 | 4 |
| Sodium carbonate (%) | 80 | 56 | 37 | 21.7 | 18 |
| Sodium sulphate (%) | — | 24 | 43 | 58.3 | 62 |
| Ratio carbonate:sulphate | infinity | 2.3 | 0.86 | 0.37 | 0.29 |
| Slurry properties at 24% moisture content | not processable | | | processable | |
| Minimum slurry moisture content for processability | 35 | 30 | 24 | 24 | 24 |
| Slurry viscosity (poise) | 19 | 16 | 15.5 | 12.0 | 12.5 |
| Slurry density (kg/liter) | 1.69 | 1.75 | 1.76 | 1.88 | 1.85 |
| % Burkeite formation | — | 37.50 | 68.75 | 100 | 80 |
| Powder bulk density (g/liter) | 632 | 700 | 720 | 840 | 820 |

I claim:

1. A process for the production of a detergent powder by spray-drying, which comprises the steps of:

(i) preparing an aqueous crutcher slurry comprising nonionic surfactant, sodium carbonate and sodium sulphate in a weight ratio of said carbonate to said sulphate not exceeding 1:1, and having a water content not exceeding 25% by weight; and (ii) spray-drying the slurry to give a powder comprising from 5 to 15% by weight of the nonionic surfactant, from 15 to 40% by weight of sodium carbonate, and sodium sulphate in a weight ratio of sodium carbonate to sodium sulphate not exceeding 1:1, and having a bulk density of at least 675 g/liter.

2. A process as claimed in claim 1, wherein the water content of the slurry is within the range of from 20 to 24% by weight.

3. A process as claimed in claim 1, wherein the weight ratio of sodium carbonate to sodium sulphate is within the range of from 0.2:1 to 1:1.

4. A process as claimed in claim 3, wherein the weight ratio of sodium carbonate to sodium sulphate is within the range of from 0.25:1 to 0.90:1.

5. A process as claimed in claim 1, wherein the powder has a bulk density within the range of from 700 to 900 g/liter.

6. A spray-dried detergent powder made by the process of claim 1, from 15 to 40% by weight of sodium carbonate, and sodium sulphate in a weight ratio of sodium carbonate to sodium sulphate not exceeding 1:1, and having a bulk density of at least 675 g/liter.

* * * * *